United States Patent [19]

Weinstein et al.

[11] Patent Number: 5,039,019

[45] Date of Patent: Aug. 13, 1991

[54] INDIRECT CHARGING ELECTROSTATIC COATING APPARATUS

[75] Inventors: Richard Weinstein, Toledo; Kenneth J. Coeling, Westlake, both of Ohio

[73] Assignee: Illinois Tool Works, Inc., Chicago, Ill.

[21] Appl. No.: 564,760

[22] Filed: Aug. 1, 1990

[51] Int. Cl.[5] ..... B05B 5/00

[52] U.S. Cl. ..... 239/691

[58] Field of Search ..... 239/690, 691, 706

[56] References Cited

U.S. PATENT DOCUMENTS 2,710,773 6/1955 Sedlacsik .
3,393,662 7/1968 Blackwell .
3,408,985 11/1968 Sedlacsik, Jr. ..... 239/706
4,225,090 9/1980 Kako et al. .
4,872,616 10/1989 Behr et al. .

FOREIGN PATENT DOCUMENTS 178746 4/1986 European Pat. Off. .
8810152 12/1988 World Int. Prop. O. ..... 239/691

*Primary Examiner*—Andres Kashnikow
*Assistant Examiner*—Lesley D. Morris
*Attorney, Agent, or Firm*—MacMillan, Sobanski & Todd

[57] ABSTRACT

Electrostatic coating apparatus including apparatus for establishing an electrostatic field for indirectly charging atomized droplets of paint or other coating material discharged from an atomizer. A flexible tube is formed into an annulus and is positioned coaxially with the atomizer. Pins extend through the tube and have short ends which project towards a workpiece to be coated. The tube is formed from an insulating outer layer and a semi-conducting inner layer having a high distributed resistance. The pins extend through the inner layer which is connected through a large resistance to a high voltage power supply. The apparatus is particularly useful for charging electrically conductive and semi-conductive materials delivered to the atomizer from a grounded source.

9 Claims, 3 Drawing Sheets

INDIRECT CHARGING ELECTROSTATIC COATING APPARATUS

TECHNICAL FIELD

The invention relates to electrostatic coating apparatus and more particularly to apparatus for indirectly imparting an electrostatic charge to atomized electrically conductive coating materials.

BACKGROUND ART

For increased transfer efficiency, paints and other atomized or particulate coatings are often electrostatically charged when applied to a workpiece. A very high voltage electrostatic charge is imparted to the atomized paint droplets or other coating particles relative to the workpiece. The charge causes the droplets to be attracted to the workpiece, even when they are initially moving on a path away from the workpiece. Solvent based coatings generally are easily charged because they are electrically nonconductive. Typically, a high voltage electrode is located at the spray gun nozzle for contacting the paint as it is discharged and atomized. However, precautions must be taken to prevent sparking from the electrode since solvent based paints generally are flammable. Direct charging is unsatisfactory when an electrically conductive paint, such as a water borne paint, or a semi-conducting paint is being applied. Normally, the paint is supplied to the gun from an electrically grounded remote source. The high voltage on an electrode exposed to the paint column at the gun nozzle will be dissipated through the paint column to the grounded paint source. Consequently, the paint is not adequately charged.

Various techniques have been used in the past for electrostatically applying electrically conductive and semi-conductive paints and other coating materials. One technique is to electrically isolate the entire paint supply from ground. During coating, the paint from the atomizer to the source is maintained at a high voltage. Extra care must be taken with a system of this type in protecting the operator from contact with the high voltage and in preventing arcing from all portions of the paint supply. Further, this type of system provides a greater risk because of the large charged capacitance formed by the paint supply system. As the stored high voltage energy increases, there is a greater risk of harm from any spark discharge. According to another technique, paint is supplied from a grounded source to an intermediate reservoir which is isolated from ground. Various arrangements have been used to provide a voltage block between the grounded source and the isolated reservoir which is maintained at a high voltage at lease during spraying. Still another technique involves indirectly charging the paint after it is atomized by establishing a strong electrostatic field adjacent the paint discharge end of the atomizer. The atomized paint becomes charged as it passes through the field. This technique permits grounding the atomizer and the entire paint supply system.

In one type of indirect charging apparatus, an electrically insulated annular or hoop shaped element is supported from a rotary atomizer to be spaced outwardly from and slightly behind the paint discharge edge. A plurality of small needle like electrodes are uniformly spaced around the element and are positioned to point in a forward direction toward the workpiece being coated. An electrical conductor embedded in the element connects the electrodes together to a high voltage source. In order to prevent conductive deposits from accumulating on the element which in turn will reduce the strength of the electrostatic field produced by the electrodes, the portions of the electrodes projecting from the element are embedded in insulation. The insulation on the electrodes also is required for safety. Even though a large value resistor may be placed in the power supply lead to limit the available current and voltage as a grounded object approaches an electrode, the resistor has limited effect because it is located before the metal conductor in the annular element. The metal conductor which interconnects the electrodes has a distributed capacitance which becomes charged with the high voltage. There is no guarantee that water borne or other conductive and semi-conductive paints do not contain flammable or incentive solvents or that the user will not on occasion switch to flammable solvent based paints. Sufficient energy may be stored in the capacitance formed by the metallic conductor to ignite any flammable solvents if a grounded object is brought sufficiently close to an electrode to cause a spark.

DISCLOSURE OF INVENTION

According to the invention, improved apparatus is provided for indirectly charging electrically conductive paints and other conductive coating materials. The apparatus includes a clamping collar which is designed to clamp onto the housing of an atomizer. The position of the collar is axially adjustable on the atomizer housing. A plurality of support rods project outwardly and forwardly from the collar along a conical path. A flexible tube is formed into a loop and is secured to the free ends of the support rods to form an annulus spaced coaxially with the atomizer and to the rear of the atomized paint discharge. The collar, the support rods and the exterior of the flexible tube are formed from electrically insulating materials. The flexible tube has a semi-conducting interior layer having a high resistance. A plurality of uniformly spaced pins are pushed through the tube to form high voltage electrodes. The pins have short pointed ends which project towards the workpiece to be coated. The pins are closely spaced to extend around the tube concentric with the atomizer axis. Electric power is applied through a large value resistor to the semi-conducting interior layer in the tube and thence through the semi-conducting layer to the various pins. The charged pins establish a high intensity field between the pins and a grounded surface on the atomizer. The atomized coating material is charged as it passes through the high intensity field. The charged material is then drawn to the workpiece by a lower intensity field between the high voltage electrodes and the workpiece.

The semi-conducting layer reduces the risk of arcing from the pins as a grounded object approaches the apparatus and also significantly reduces the available energy if a spark should occur. Further, forming the annular element from a flexible tube reduces the risk of damage if the element should contact the workpiece being coated or any other object, for example, when the atomizer is mounted on a programmable robot for being moved along a path.

Accordingly, it is an object of the invention to provide improved apparatus for establishing an electrostatic field for indirectly charging atomized droplets of an electrically conductive or semiconductive coating material.

Other objects and advantages of the invention will become apparent from the following detailed description and the accompanying drawings.

BEST MODE FOR CARRYING OUT THE INVENTION

Figure 1:
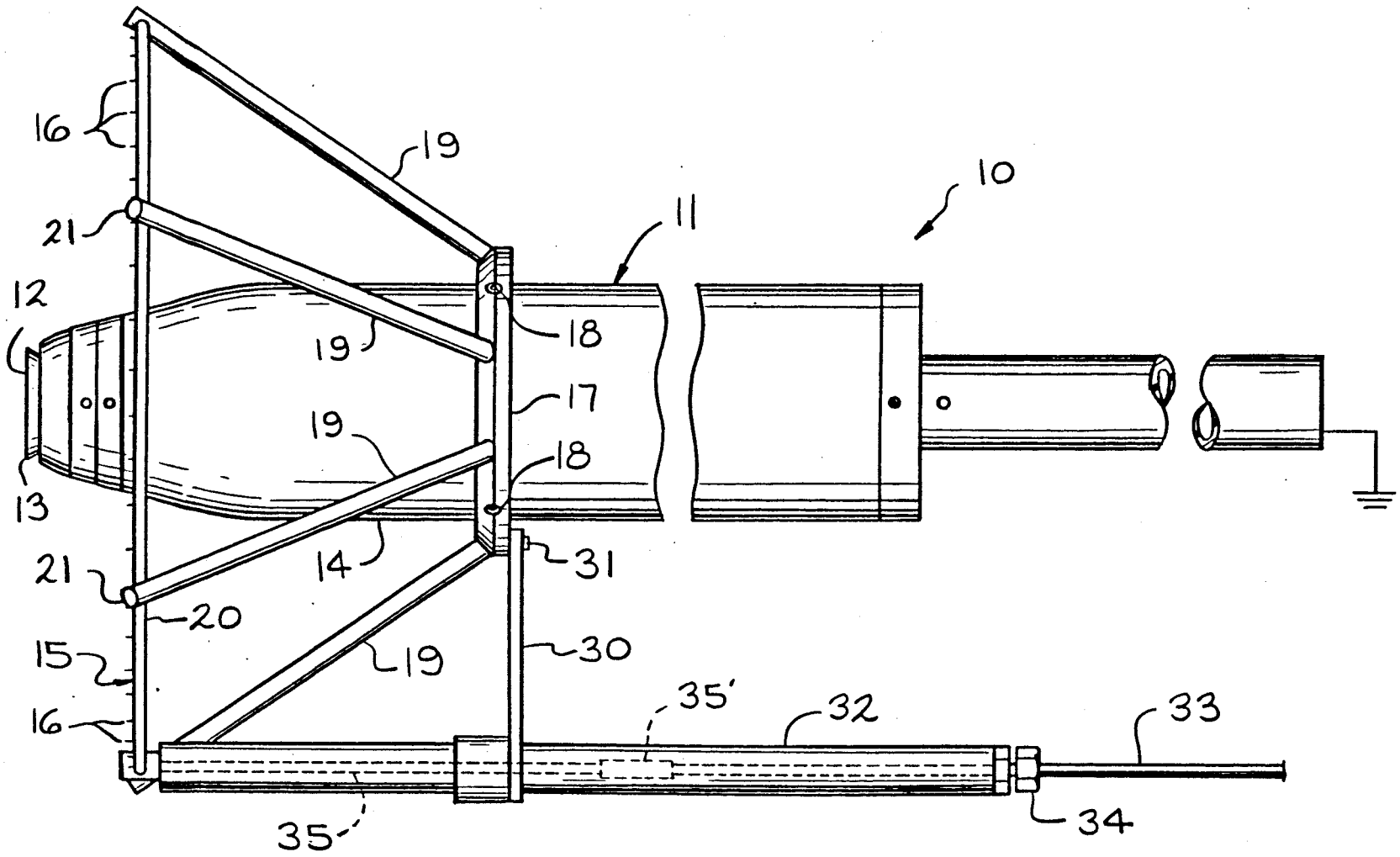
FIG. 1 is a side elevational view of electrostatic coating apparatus including a rotary atomizer and apparatus according to the invention for indirectly charging electrically conductive coating materials.
Figure 2:
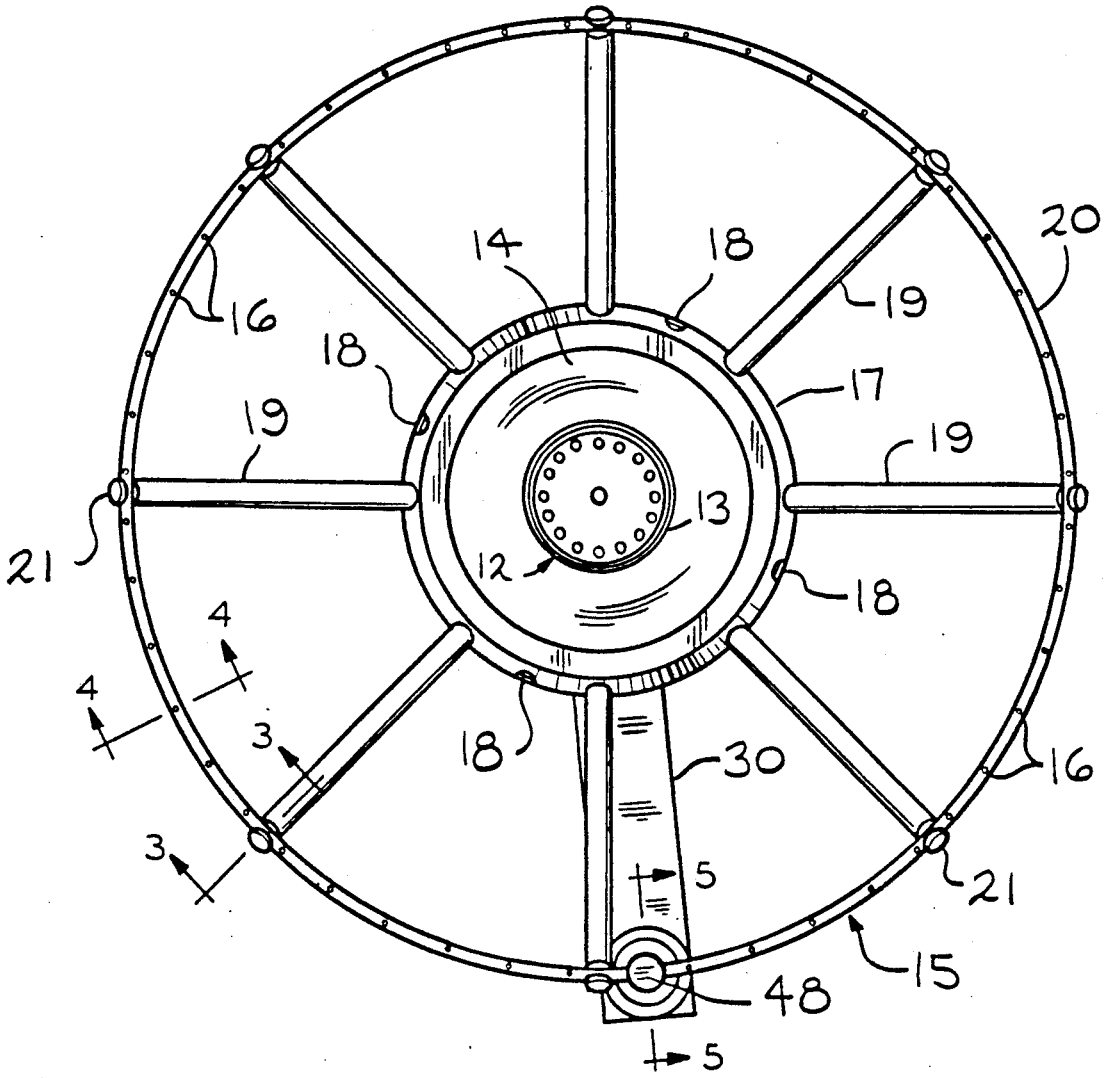
FIG. 2 is front elevational view of the apparatus of FIG. 1.

Referring to FIGS. 1 and 2 of the drawings, apparatus 10 is illustrated for applying to a workpiece (not shown) an electrostatically charged atomized coating of an electrically conductive paint or other conductive or semi-conductive material. The apparatus 10 is illustrated as including conventional rotary atomizing apparatus 11. Both the atomizing apparatus 11 and the workpiece are electrically connected to ground. The atomizing apparatus 11 includes at its front a cup shaped member or bell 12 having a peripheral edge 13 from which the paint is discharged as the bell 12 is rotated at a high speed by a suitable motor or turbine (not shown) located within a housing 14.

According to the invention, apparatus 15 is secured to the housing 14 to support a plurality of high voltage electrodes 16 coaxially with the bell 12. The electrodes 16 are positioned radially outwardly from and to the rear of the bell edge 13. When the electrodes are maintained at a high voltage relative to ground, e.g., at between 60,000 volts and 100,000 volts or more DC, a strong electrostatic field is established in the region between the electrodes 16 and the bell edge 13. This electrostatic field imparts an electrostatic charge to the atomized droplets to attract the charged droplets towards the grounded workpiece.

Figure 3:
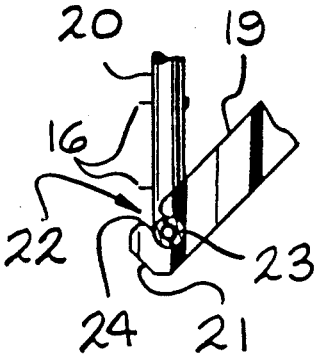
FIG. 3 is an enlarged cross sectional view as taken along line 3—3 of FIG. 2.

The apparatus 15 includes a clamping collar 17 which slides over the atomizer housing 14 and is secured in place by a plurality of setscrews 18. By loosening the screws 18, the axial position of the apparatus 15 and hence the axial location of the electrodes 16 relative to the atomizer bell edge 13 is easily adjusted. A plurality of support rods 19 are secured around the collar 17 to angle forwardly and outwardly for supporting a flexible tube 20 which is formed into an annulus or hoop. As is best seen in FIG. 3, each rod 19 has a free end 21. A notch 22 is formed in the rod 19 adjacent the end 21 for receiving and retaining the tube 20. The notch 22 has a circular portion 23 which is of a diameter to receive and retain the tube 20 and has a reduced width entrance 24. The flexible tube 20 is deformed slightly for forcing through the notch entrance 24 and expands to fill the circular portion 23 to be retained in the notch 22.

Figure 4:
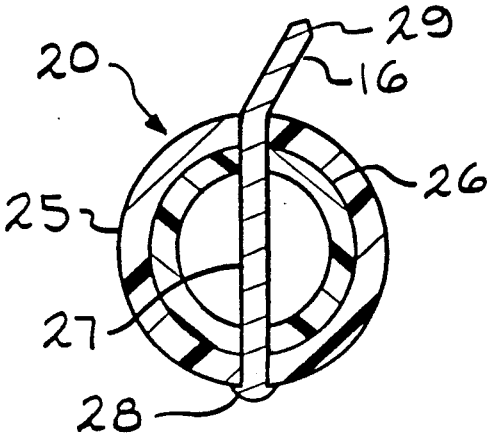
FIG. 4 is an enlarged cross sectional view as taken along line 4—4 of FIG. 2.

Except for the exposed portions of the electrodes 16, all exposed portions of the indirect charging apparatus 15 are constructed from electrically non-conducting materials, such as from Delrin, Nylon or polyethylene. As best seen in FIG. 4, the tube 20 is formed from a composite including a non-conductive outer layer 25 and a semi-conducting inner layer 26. The outer layer 25 may be, for example, a non-conductive Teflon (polytetrafluoroethylene) and the inner layer 26 may be Teflon impregnated with sufficient carbon to give the desired semi-conductive properties. The layers 25 and 26 may be formed as a dual extrusion. Or, the inner layer 26 may be a coating applied to the interior of the outer layer 25. Other possible materials for the outer layer 25 of the tube 20 include nylon, polypropylene and polyethylene. The inner layer 26 may be of any material which will adhere to or may be co-extruded with the outer layer 25 and which may be impregnated with carbon or otherwise given the desired semi-conductor properties. The inner layer preferably has a resistance on the order of at least one megohm per foot.

Each of the electrodes 16 may be in the form of a pin 27 having a headed end 28 and a free end 29. The pin 27 is pushed through the tube 20 until the head 28 abuts the tube 20 and the free end 29 projects a short distance from the opposite side of the tube 20. Although the distance that the electrode end 29 projects from the tube 20 does not appear to be critical, a projection of about 2 mm to 5 mm has been found satisfactory. Each pin 27 passes through the inner semi-conducting layer 26 to establish an electrical contact with the layer 26. Preferably, the free end 29 is pointed to increase the electrical field intensity and the free end 29 may be bent slightly to retain the pin 27 in the tube 20. The slight bend will not adversely affect the function of the pin end 29 in establishing the electrostatic field. Alternately, a barb (not shown) may be formed on the pins 27 to retain the pins 2 in the tube 20.

Figure 5:
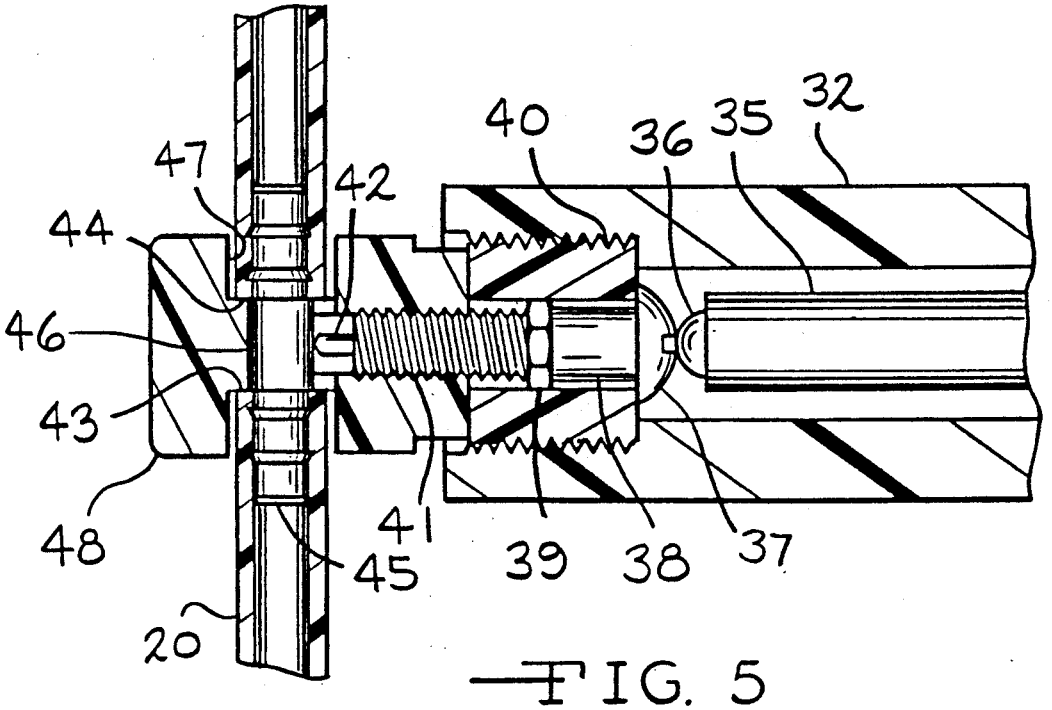
FIG. 5 is an enlarged cross sectional view as taken along line 5—5 of FIG. 2.

A bracket 30 is secured by screws 31 to the collar 17 for supporting a resistor tube 32 which is connected to apply high voltage to the inner layer 26 of the tube 20, as is illustrated in FIGS. 1, 2 and 5. High voltage is applied from a suitable remote source (not shown) through a cable 33 to the resistor tube 32. The cable 33 extends through a compression fitting 34 on the tube 32 which secures the cable 33 to the tube 32. The cable 33 has an internal conductor (not shown) which is in electrical contact with one end of a large value resistor 35, for example, a 150 megohm resistor. Optionally, the tube 32 also may house a conventional capacitor-diode voltage multiplier network 35' between the cable 33 and the resistor 35. The cable 33 then applies a lower level AC voltage to the network 35' which is multiplied and rectified by the network 35' to establish and apply the desired high level DC voltage to the resistor 35. An opposite end 36 of the resistor 35 is pressed against the head 37 of a screw 38. The screw 38 is secured by a nut 39 to a plug 40 which closes an end of the resistor tube 32 opposite the compressión fitting 34. The screw 38 has a projecting threaded portion 41 terminating at a tip 42. Thus, the screw tip 42 is maintained at the high voltage present at the resistor end 36.

The tube 20 has two open ends 43 and 44 which are connected together by a barbed fitting 45 which is pressed into the open tube ends 43 and 44 to form the tube 20 into a hoop or annulus. The fitting 45 is in electrical contact with the semi-conductive inner layer 26 at both tube ends 43 and 44. The fitting 45 is of metal or of another suitable conductive material and has a central portion 46 which forms an electrical contact. The central portion 46 of the fitting 45 and the tube ends 43 and 44 are confined within a stepped bore 47 through an electrically non-conductive housing 48. The bore 47 is intersected by a housing bore 49 which is threaded to receive the threaded portion 41 of the screw 38 projecting from the resistor tube 32. When the screw 38 is secured to the threaded housing bore 49, the tip 42 contacts the central portion 46 of the fitting 45 to apply high voltage from the resistor 35 to the inner layer 26 of the tube 20, and thence to the electrode pins 27.

As indicated in the discussion of the prior art, any conductor used to apply high voltage to the electrodes will have a distributed capacitance which will store energy. Because operating voltages may be as high as 100,000 volts or more, the energy stored in the distributed capacitance may be significant. By using a high resistance semi-conducting layer or coating 26 on the interior of a flexible non-conducting layer or tube 25 to apply voltage to the electrodes 16, the adverse effects of the distributed capacitance are cancelled by the distributed resistance to form a safe system. Both the resistance of the resistor 35 which brings the high voltage to the tube 20 and the resistance of the inner layer 26 cause the voltage at the electrodes 16 to diminish as the current increases, such as when a grounded body approaches one or more of the electrodes 16.

In operation, the indirect charging apparatus 15 establishes two electrostatic fields: an intensive field extending from the electrodes 16 to the adjacent grounded bell edge 13 and another less intensive field extending from the electrodes 16 to the more remotely located workpiece. It has been observed that the greatest charge possible is imparted to the atomized paint droplets when they move through the high intensity field at right angles to the electrostatic field lines. It also has been observed that once charged, the atomized particles tend to move along the lines of an electrostatic field. As the paint droplets are discharged outwardly from the bell edge 13, they pass through the stronger electrostatic field and become charged. As the droplet stream widens, the droplets then align themselves in the weaker field between the electrodes 16 and the workpiece and are drawn to the workpiece.

Figure 6:
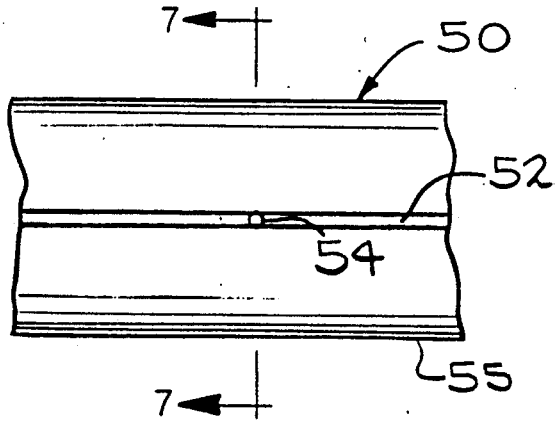
FIG. 6 is an enlarged front elevational view of a fragmentary portion of a modified embodiment of the tube holding the high voltage electrodes.
Figure 7:
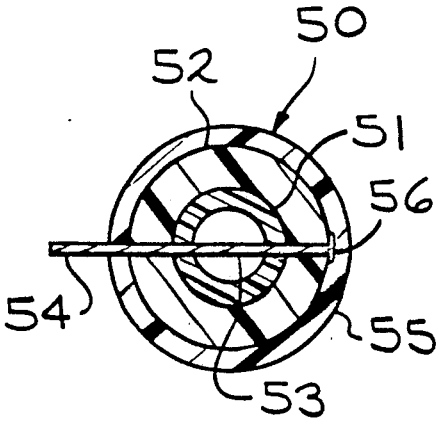
FIG. 7 is a cross sectional view as taken along line 7—7 of FIG. 6.

FIGS. 6 and 7 show a modified tube 50 which includes a semi-conducting inner layer 51 and a non-conducting outer layer 52. Pins 53 are pushed through the tube 50 to form projecting electrodes 54 which are electrically connected together and are connected to a high voltage source (not shown) by the semi-conducting layer 51. A split jacket 55 is positioned over the tube 50 to cover a head 56 on each pin 53. The jacket 55 insulates the pin heads 56 from any grounded object brought into proximity to the rear of the tube 50.

The above described apparatus 15 for indirectly charging electrically conductive paints and other materials has several advantages over similar prior art devices. Since the tube 20 is constructed from flexible materials, the risk of collision damage to the tube 20 and to any objects in the vicinity of the tube 20 are reduced. By using a high resistance semiconductor within the tube 20 for applying high voltage to the electrodes, the apparatus 15 is safer then prior art apparatus which uses a low resistance conductor. Further, the position of the apparatus on the atomizer housing is readily adjustable to obtain maximum charging efficiency and to minimize the risk of paint accumulating on the tube 20. Although the apparatus 15 is particularly useful for electrostatically charging atomized electrically conductive paints and other materials, it also is effective for charging atomized semi-conductive and non-conductive coating materials containing either non-flammable or flammable solvents.

The apparatus 15 has been described as being used with a rotary atomizer. It will be appreciated that the apparatus 15 will also function with other types of atomizers, such as atomizers using either compressed air atomization or hydrostatic pressure atomization. In either case, the apparatus is mounted on the atomizer body with the high voltage electrodes surrounding and uniformly spaced from the atomizer nozzle. Either the nozzle or air cap is grounded or a grounded wire electrode is located to project from the center of the nozzle. A strong electrostatic field is established between the grounded nozzle, air cap or electrode and the surrounding high voltage electrodes for charging the paint as it is atomized. The paint is then drawn to the workpiece by the weaker electrostatic field between the high voltage electrodes and the grounded workpiece. It will be appreciated by those skilled in the art that various other modifications and changes may be made in the above described apparatus for indirectly charging conductive coating materials without departing from the spirit and the scope of the following claims.

We claim:

1. Apparatus for indirectly charging electrically conductive liquid discharged from an atomizer to coat a grounded workpiece, said atomizer having an electrically grounded member located in the vicinity of where the atomized liquid is discharged from said atomizer, said apparatus comprising, in combination, a tube formed into an annulus, means for mounting said annular tube to surround the atomizer at a uniform spacing from where the atomized liquid is discharged from the atomizer, said annular tube having an electrically non-conductive outer layer and a high resistance semi-conducting inner layer, a plurality of electrode pins extending through said annular tube, each of said pins electrically contacting said semi-conducting layer and having an electrode end projecting from a side of said annular tube facing toward the workpiece, said electrode ends having a uniform spacing from the discharge axis of the atomized liquid, and means for applying a high voltage to said semi-conducting layer to establish an electrostatic field between said electrode ends and the grounded atomizer member.

2. Apparatus for indirectly charging electrically conductive liquid discharged from an atomizer, as set forth in claim 1, wherein said tube is comprises a dual extrusion forming said non-conducting outer layer and said semi-conducting inner layer.

3. Apparatus for indirectly charging electrically conductive liquid discharged from an atomizer, as set forth in claim 2, wherein said outer tube layer is of a non-conductive polytetrafluoroethylene and said inner tube layer is of a carbon impregnated polytetrafluoroethylene.

4. Apparatus for indirectly charging electrically conductive liquid discharged from an atomizer, as set forth in claim 1, wherein reach of said pins has a head retained against a side of said annular tube facing away from the workpiece, and wherein the electrode end of each of said pins is bent to retain such pin in said annular tube.

5. Apparatus for indirectly charging electrically conductive liquid discharged from an atomizer, as set forth in claim 1, wherein said means for mounting said annular tube includes a collar, means on said collar for releasably engaging a housing for the atomizer at different positions axially spaced on the housing, a plurality of support rods projecting from said collar outwardly and forwardly towards the workpiece, said support rods each having a free end spaced from said collar defining means for retaining and supporting said annular tube.

6. Apparatus for indirectly charging electrically conductive liquid discharged from an atomizer, as set forth in claim 1, wherein said annular tube has two open ends, and further including an electrically conductive barbed fitting extending into said open ends to connect said open ends together, said fitting electrically contacting said inner layer at each of said open ends, and wherein said means for applying a high voltage to said semi-conducting layer includes a high value resistor having a first end for connecting to a high voltage source and having a second end, and means connecting said second resistor end to said barbed fitting.

7. Apparatus for indirectly charging electrically conductive liquid discharged from an atomizer, as set forth in claim 6, wherein said resistor is mounted in a non-conducting second tube, and wherein said means connecting said second resistor end to said barbed fitting comprises interconnected internal and external terminal surfaces at one end of said second tube, said resistor contacting said internal terminal surface, and means connecting said one second tube end to said annular tube with said external terminal surface contacting said barbed fitting.

8. Apparatus for indirectly charging electrically conductive liquid discharged from an atomizer, as set forth in claim 7, and further including a voltage multiplier located in said second tube, said voltage multiplier having a high voltage DC output applied to said first resistor end, and cable means for applying a lower level AC voltage to an input to said voltage multiplier.

9. Apparatus for indirectly charging electrically conductive liquid discharged from an atomizer, as set forth in claim 1, wherein said semi-conducting inner layer has a resistance of at least one megohm per lineal foot of said annular tube.

* * * * *